US007059908B2

(12) United States Patent
Yamaguchi

(10) Patent No.: US 7,059,908 B2
(45) Date of Patent: Jun. 13, 2006

(54) ELECTRICAL CONNECTOR HAVING A SHIELD

(75) Inventor: Hideto Yamaguchi, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 11/196,423

(22) Filed: Aug. 4, 2005

(65) Prior Publication Data

US 2006/0040557 A1 Feb. 23, 2006

(30) Foreign Application Priority Data

Aug. 18, 2004 (JP) ..... 2004-238205

(51) Int. Cl.
*H01R 13/648* (2006.01)

(52) U.S. Cl. ..... 439/609

(58) Field of Classification Search ..... 439/609, 439/660, 74, 607
See application file for complete search history.

(56) References Cited

U.S. PATENT DOCUMENTS 5,697,799 A * 12/1997 Consoli et al. ..... 439/181
5,915,976 A * 6/1999 McHugh ..... 439/74
5,921,814 A * 7/1999 Maruyama ..... 439/607
6,042,398 A * 3/2000 Wu et al. ..... 439/101
6,095,824 A * 8/2000 McHugh ..... 439/74
6,179,626 B1 * 1/2001 Wu ..... 439/74
6,250,935 B1 * 6/2001 Mochizuki et al. ..... 439/74
6,343,951 B1 * 2/2002 Ono et al. ..... 439/571
6,379,186 B1 * 4/2002 Shi et al. ..... 439/607
6,390,833 B1 * 5/2002 Chang ..... 439/108
6,394,841 B1 * 5/2002 Matsuura ..... 439/607
6,439,928 B1 * 8/2002 Akama et al. ..... 439/608
6,464,515 B1 * 10/2002 Wu ..... 439/108
6,485,328 B1 * 11/2002 Wu ..... 439/567
6,500,013 B1 * 12/2002 Wang ..... 439/108
6,503,101 B1 * 1/2003 Yu ..... 439/607
6,533,614 B1 * 3/2003 Akama et al. ..... 439/608
6,551,139 B1 * 4/2003 Yu ..... 439/607
6,663,402 B1 * 12/2003 Yu ..... 439/108
6,672,887 B1 * 1/2004 Yu ..... 439/108
6,726,492 B1 * 4/2004 Yu ..... 439/108
6,764,314 B1 * 7/2004 Lee ..... 439/65
6,805,586 B1 * 10/2004 Akama et al. ..... 439/608
6,910,900 B1 * 6/2005 Pan ..... 439/108
6,910,921 B1 * 6/2005 Pan et al. ..... 439/607
6,923,659 B1 * 8/2005 Zhang et al. ..... 439/74
6,929,510 B1 * 8/2005 Pan ..... 439/607
6,948,951 B1 * 9/2005 Wu et al. ..... 439/108
6,948,954 B1 * 9/2005 Fan ..... 439/137
2003/0176110 A1 * 9/2003 Wu et al. ..... 439/660
2004/0115993 A1 * 6/2004 Lai ..... 439/660
2005/0032400 A1 * 2/2005 Zhang et al. ..... 439/74
2005/0032427 A1 * 2/2005 Hu et al. ..... 439/607
2005/0032434 A1 * 2/2005 Zhang et al. ..... 439/660

(Continued)

*Primary Examiner*—Ross Gushi
(74) *Attorney, Agent, or Firm*—Takeuchi&Kubotera, LLP

(57) ABSTRACT

A shielding member (30) of the receptacle connector (A) has a fully shielding structure that surrounds the connector fitting section (2), and the shielding member (80) of the plug connector (B) has a fully shielding structure that surrounds the connector fitting section (54).

16 Claims, 16 Drawing Sheets

U.S. PATENT DOCUMENTS

2005/0037642 A1* 2/2005 Zhang ..... 439/74
2005/0042924 A1* 2/2005 Zhang et al. ..... 439/607
2005/0048841 A1* 3/2005 Pan ..... 439/607
2005/0095881 A1* 5/2005 Fan ..... 439/74
2005/0095913 A1* 5/2005 Fan ..... 439/607
2005/0095914 A1* 5/2005 Fan ..... 439/607
2005/0101163 A1* 5/2005 Obikane et al. ..... 439/74
2005/0277334 A1* 12/2005 Huang ..... 439/607
2006/0040559 A1* 2/2006 Zhang et al. ..... 439/609
2006/0052008 A1* 3/2006 Pan et al. ..... 439/660

* cited by examiner

ELECTRICAL CONNECTOR HAVING A SHIELD

BACKGROUND OF THE INVENTION

1. Field of the Invention

The present invention relates to an electrical connector having a shield, in which two connectors (a receptacle connector and a plug connector) are respectively shielded and mounted on a different printed circuit board so as to connect those printed circuit boards to each other.

2. Description of the Related Art

Conventionally, an electrical connector, which connects flat printed circuit boards to each other, is widely used. This type of electrical connector is respectively mounted on a different printed circuit board, and comprised of a receptacle connector and a plug connector, which connect to each other. By connecting the receptacle connector with the plug connector, the printed circuit boards are connected to each other.

The receptacle connector and the plug connector respectively have a connector fitting section on the respective connector housings, and each connector fitting section has a plurality of contact terminals, which are arranged thereon by a specified pitch. Usually, the contact terminals arranged on the connector housing of the receptacle connector have spring-like characteristics. Once the receptacle connector is connected to the plug connector, the contact terminals arranged on the respective connector housings are electrically connected to each other by contacting through pressure by the spring-like characteristics. The above-described receptacle connector and plug connector are connectors having a shield, and a shielding member is attached to the respective connector housings.

As shown in FIG. 34, the shielding member of the receptacle connector is comprised of side shielding plates 100, which are attached along both sides of the connector housing in the longitudinal direction of the connector, and end shielding plates 101, which are arranged at both ends of the connector of the connector housing in the lateral direction of the connector. The end shielding plates 101 are non-contact shields, which are not connected to the side shielding plates 100.

The shielding member of the plug connector is described in the patent reference 1. As shown in FIG. 34, the shielding member is comprised of side shielding plates 102, which are attached along both sides of the connector housing (not illustrated) in the longitudinal direction of the connector, and end shielding plates 103, which are arranged on both end surfaces of the connector housing in the lateral direction of the connector. Both ends of the end shielding plates 103 are curved, and have contact point sections 105 at the curved sections 104. By contacting those contact point sections with the side shielding plates 102, the side shielding plates 102 and the end shielding plates 103 are connected to each other.

In addition, in order to attach each of the side shielding plates 100 and 102 to both side surfaces of the connector housing, the side shielding plates 100 and 102 have a inverted U-shaped contact tongue section. By hooking the contact tongue sections to both side surfaces of the connector housing, those side shielding plates are attached to the connector housing. Moreover, in order to contact the contact tongue sections with the connector housing, the side shielding plates 100 and 102 have protrusions (not illustrated). In order to generate elastic force to press the protrusions to the connector housing, the side shielding plates 100 and 102 have a windows (not illustrated) near the protrusions. Patent Reference: Unexamined Japan Patent Application Publication H11-233201

As for the shielding member of the receptacle connector, the side shielding plates 100 are not connected to the end shielding plates 101, and there are unshielded portions between the side shielding plates 100 and the end shielding plates 101. Accordingly, when the receptacle connector is jointed to the plug connector, although the shielding members of the plug connector surround the shielding members of the receptacle connector, there are unshielded portions, and there is a plurality of windows on the side shielding plates 100. Therefore, there are problems such as unstable data transmission or communication error in an electronic device due to noise leakage. Especially, since high-speed signal transmission has been advanced in these years, those problems become more obvious.

Furthermore, in the shielding member of the plug connector, the end shielding plates 103 are provided near the end surfaces of the connector housing. There is some space between the end surface and the connector fitting section, which is not efficiently used and makes difficult to reduce the size of the connector.

SUMMARY OF THE INVENTION

Accordingly, it is an object of the invention to provide an electrical connector having a shield, whereby problems such as unstable data transmission or communication error in an electronic device due to noise leakage can be solved and smaller electrical connector having a shield can be provided.

In order to solve the above problems, the electrical connector having a shield according to this invention is comprised of a pair of connectors. One connector has a connector fitting section on the connector housing, a plurality of contact terminals on the connector fitting section, and a shielding member on the connector housing. The other connector has a counter connector fitting section on the connector housing, a plurality of counter contact terminals on the counter connector fitting section, and a counter shielding member on the connector housing. In the above electrical connector having a shield, when those connectors are connected by fitting and jointing the connector fitting section to the counter connector fitting section, the contact terminals and the counter contact terminals, and shielding member and the counter shielding member are respectively contacted and connected to each other. The shielding member is designed to form a shielding structure that surrounds the connector fitting section, and the counter shielding member is designed to have a shielding structure that surrounds the counter connector fitting section.

According to the above-described constitution, a complete shielding structure, in which the shielding member surrounds the connector fitting section, is formed, and another complete shielding structure, in which the counter shielding members surround the counter connector fitting section, is formed. Therefore, when the pair of the connectors are jointed by fitting the connector fitting section to the counter connector fitting section, doubled shielding structure is formed. Therefore, problems such as unstable data transmission or communication error in the electronic device due to noise leakage can be solved.

In addition, in the electrical connector having a shield according to this invention, the shielding member is comprised of side shields that cover the connector fitting section from both sides in the longitudinal direction of the connector, and end shields that covers the connector fitting section from both ends in the lateral direction of the connector. On the other hand, the counter shielding member is comprised of counter side shields that cover the counter connector fitting section from both sides in the longitudinal direction of the connector, and counter end shields that cover the counter connector fitting section from both ends in the lateral direction of the connector.

According to the above-described constitution, the connector fitting section is shielded by the side shields and end shields, while the counter connector fitting section is shielded by the counter side shields and the counter end shields. When the pair of the connectors are jointed by fitting the connector fitting section to the counter fitting section, double shielding structure is formed, and therefore problems such as unstable data transmission or communication error in an electronic device due to noise leakage can be solved.

Furthermore, in the electrical connector having a shield according to this invention, one connector has a side shield attaching section on both side surfaces of the connector housing in the longitudinal direction of the connector, and has an end shield attaching section between both end surfaces and the connector fitting section of the connector housing in the lateral direction of the connector. The side shields are attached to the side shield attaching sections, and the end shields are attached to the end shield attaching sections. On the other hand, the other connector has a counter side shield attaching sections on both side surfaces of the connector housing in the longitudinal direction of the connector, and a counter end shield attaching section in the connector lateral direction between both end surfaces and the counter connector fitting section. The counter side shields are attached to the counter side shield attaching sections, while the counter end shields are attached to the counter end shield attaching sections.

According to the above constitution, one connector has end shield attaching section along the connector lateral direction of the connector between both end surfaces housing and the connector fitting section, and the end shields are attached to the end shield attaching sections. The other connector has counter end shield attaching sections in the lateral direction of the connector between both end surfaces and the counter connector fitting section, and the counter end shields are attached to the counter end shield attaching sections. Therefore, the space can be effectively used, and therefore the size of the electrical connector having a shield can be reduced.

Furthermore, in the above-described electrical connector having a shield according to this invention, the contact between the shielding member and the counter shielding member is made by contacting between the side shields and the counter side shields and between the end shields and the counter end shields. In addition, side shields or counter side shields have protrusions, and the other (counter side shields or side shields) have hole, so that clicking feeling can be generated at the time of the contact by inserting the protrusions in the holes.

According to the above-described constitution, in one or the other connector, when the connector fitting section is fitted and jointed to the counter connector fitting section, shielding members contact to each other. At this time, the protrusions are inserted into the holes, so that the clicking feeling is generated. The worker can feel the clicking feeling, and can confirm the contact of the shielding member with the counter shielding member.

Furthermore, in the electrical connector having a shield according to this invention, each of the end shield attaching sections has an end shield insertion groove along the connector lateral direction, and each of the side shield attaching sections has a side shield groove along the longitudinal direction of the connector. The connector housing has one connecting section, which connects the side shield groove to the side shield insertion groove. End shield has one contact point section, and each side shield has one contact point contact section. By inserting the end shield in the end shield insertion groove, one contact point section is protruded from one connecting section toward the side shield groove. In addition, side shields are attached to the side shield grooves, and one contact point contact section is contacted with one contact point section. Each counter end shield attaching section has a counter end shield insertion groove along the connector lateral direction. The connector housing has the other connecting section, which connects the counter shield insertion groove to the counter shield attaching section. Each counter end shield has the other contact point section, and the counter side shield has the other connecting section. By inserting the counter end shield in the counter end shield insertion groove, the other contact point section is protruded from the other connecting section toward the counter side shield attaching section. By attaching the counter side shield to the counter side shield attaching section, the other contact point section is contacted with the other contact point contact section.

According to the above-described constitution, the shielding member of one connector can be designed as a complete shielding structure that surrounds the connector fitting section. Also, the counter shielding member of the other connector can be designed as a complete shielding structure that surrounds the counter connector fitting section.

In the above-described electrical connector having a shield according to this invention, the connector fitting section and the counter connecter fitting section respectively have a guiding section. Therefore, at the time of fitting the connector fitting section to the counter connector fitting section, the connector fitting section is guided to the counter connector fitting sections so as to fit thereto by contacting the guiding sections to each other.

According to the above-described constitution, when the connector fitting section is fitted into the counter connector fitting section, the guiding section of the connector fitting section contacts with the guiding section of the counter connector fitting section, so that the connector fitting section is guided to the counter connector fitting section so as to fitted thereto, and dislocation of the centers of the connectors is corrected.

In the above-described electrical connector having a shield according to this invention, the counter connector fitting section has a number of terminal attaching grooves, and mold stopper sections that protrude from the base portion of both side wall of the terminal attaching grooves, so as to form a structure to hold each terminal. Each counter contact terminal is comprised of a attaching section, a terminal lead section provided at the end of the attaching section, a securing section that is curved opposite to the terminal lead section, curved connecting section that is curved so as to form generally U-shape and provided at the end of the securing section, and a contact section formed at the end of the curved connecting section. The width L1 of the contact section is set larger than the width L2 of the curved connecting section. The width L3 of the securing section is set smaller than the width L1 of the contact section, but larger than the width L2 of the curved connecting section. By attaching each counter contact terminal to the corresponding terminal attaching section, the securing section is secured being pressed by the mold stopper sections.

According to the above-described constitution, since the width L3 of the securing section is set smaller than the width L1 of the contact section, even if the pitch P between the contact terminals is small, e.g. 0.4 mm, the mold section between the adjacent terminal attaching grooves can be made large, so that generation of cracks of the mold sections can be prevented.

According to the electrical connector having a shield of this invention, the shielding member is designed as a complete shielding structure, which surrounds the outer perimeter of the connector fitting section, and the counter shielding member has a complete shielding structure, which surrounds the outer perimeter of the counter connector fitting section. Therefore, when one connector is fitted to the other connector by fitting and jointing the connector fitting section to the counter connector fitting section, shielding is doubled, so that problems such as unstable data transmission or communication error in an electronic device due to noise leakage can be solved.

Furthermore, according to the electrical connector having a shield of this invention, one connector has end shield attaching sections in the connector lateral direction between the end surfaces of the connector housing and the connector fitting section, and the end shields are attached to the end shield attaching sections. On the other hand, the other connector has counter end shield attaching sections in the connector lateral direction between both end surfaces of the connector housing and the counter connector fitting sections, and the counter end shields are attached to the counter end shield attaching sections. Therefore, space can be effectively used, and the size of the electrical connector having a shield can be reduced.

According to the electrical connector having a shield of this invention, when the connector fitting sections are fitted to the counter connector fitting sections, the guiding sections of the connector fitting section contact with the guiding sections of the counter connector fitting sections, and the connector fitting section is guided to the counter connector fitting sections so as to fit thereto. Accordingly, the dislocation of the centers of the connectors is corrected.

According to the electrical connector having a shield of this invention, since the width L3 of the securing section is set smaller than the width L1 of the contact section, even if the pitch P between the contact terminals is as small as 0.4 mm, for example, the mold sections between adjacent terminal attaching grooves can be made large, and generation of cracks of the mold sections can be prevented.

BEST MODE FOR CARRYING OUT THE INVENTION

Figure 1:
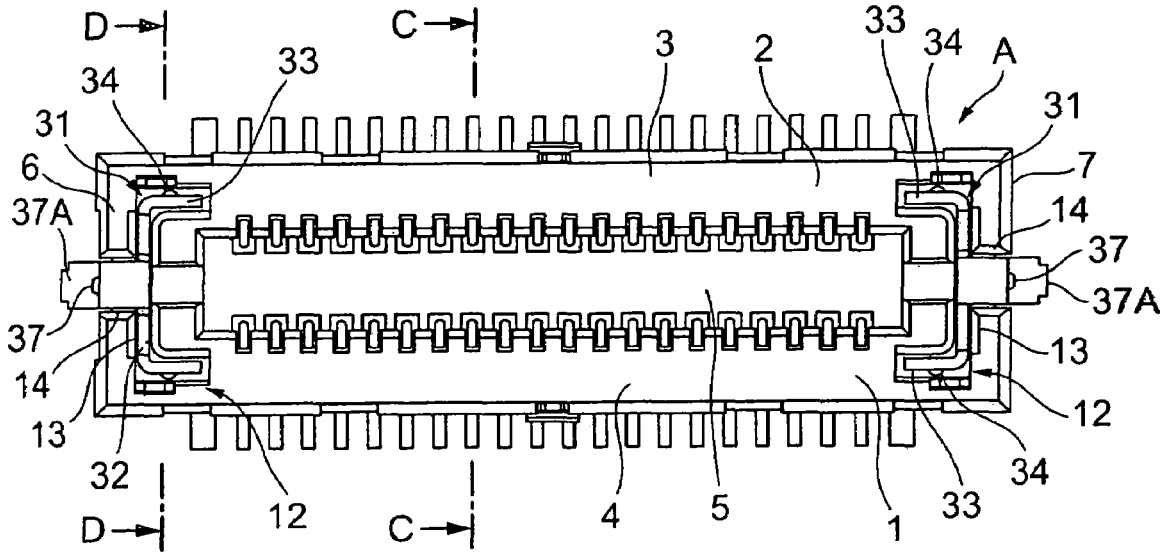
FIG. 1 is a top view of the receptacle connector in the electrical connector having a shield according to this invention.

Embodiments of the invention will now be fully described with reference to the accompanying drawings.

As shown in FIGS. 1–9, the receptacle connector A, which is one connector that composes the electrical connector of this invention, is comprised of a connector housing 1, a number of contact terminals 29 attached to terminal attaching sections 9, which are provided on a connector fitting section 2 of the connector housing 1, and a shielding member 30.

More specifically, the connector housing 1 has a convex shape, and is comprised of wall sections 3 and 4 provided along the longitudinal direction of the connector housing 1, and wall sections 6 and 7 provided along the lateral direction of the connector housing 1. In addition, space 5 is formed being surrounded by the wall sections 3, 4, 6 and 7, and a counter connector fitting section 2 is formed by the outer surfaces of the wall sections 3, 4, 6 and 7. Guiding sections 2A are formed at the edges at the outer surface sides of respective wall sections 3, 4, 6 and 7 by beveling.

Figure 8:
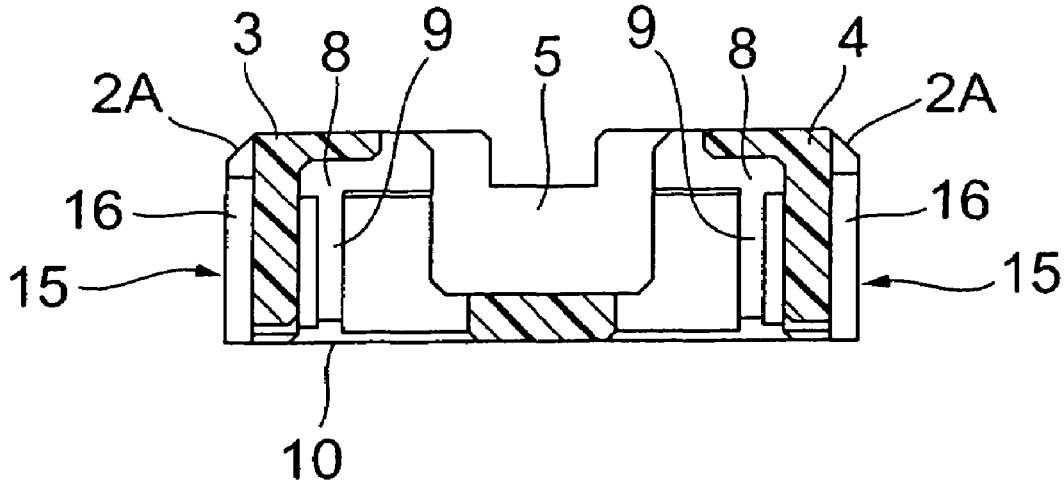
FIG. 8 is a cross-sectional view taken along line E—E of FIG. 6.

As shown in FIG. 8, a number of dividing sections 8 are protruded along the longitudinal direction of the connector by a specified pitch from the inner surfaces of the wall sections 3 and 4. Terminal attaching sections 9 are formed by the space between adjacent dividing sections 8. Terminal insertion openings 10 connected to bottoms of the terminal attaching sections 9 are formed at the connector housing 1

Figure 6:
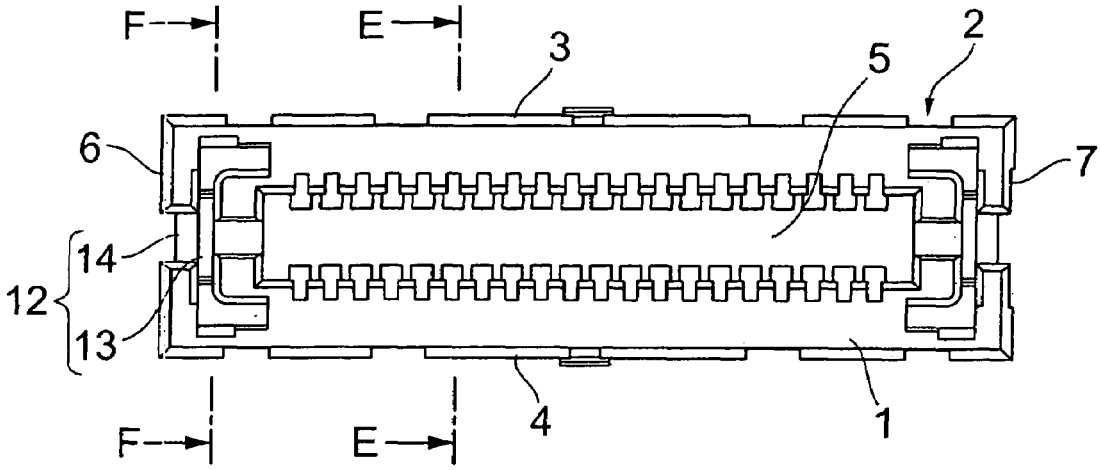
FIG. 6 is a top view of the connector housing of the receptacle connector of FIG. 1.
Figure 9:
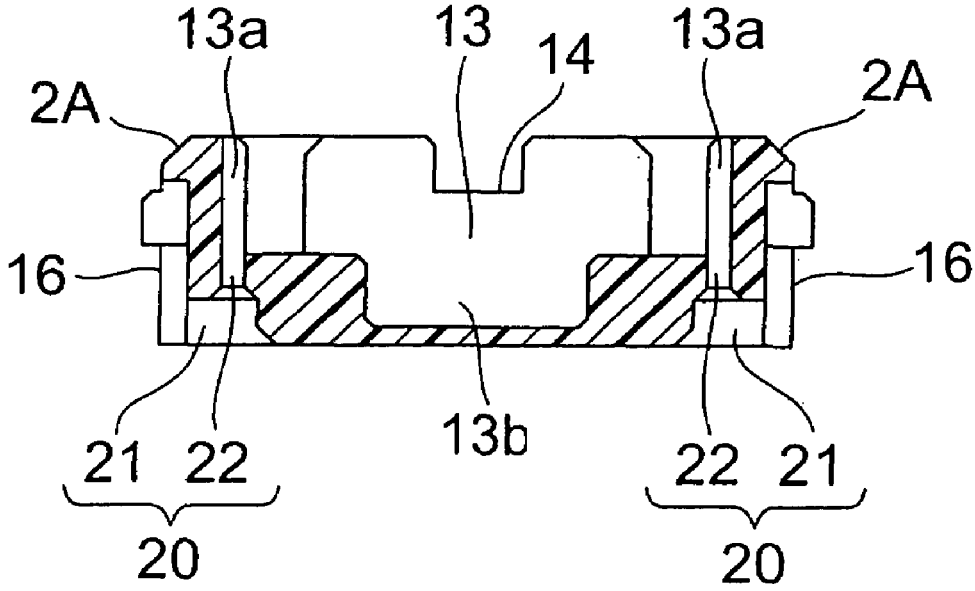
FIG. 9 is a cross-sectional view taken along line F—F of FIG. 6.

End shield attaching sections 12 are provided on the surface of the connector housing 1 at both ends in the longitudinal direction of the connector being close to the ends of the connector fitting sections 2. As shown in FIG. 6, each of those end shield attaching sections 12 is comprised of a first end shield insertion groove 13, which has a squared U-shape on its cross-sectional view, and a second end shield insertion groove 14, which is perpendicular to the first end shield insertion groove 13. As shown in FIG. 9, an insertion groove 13*a* is formed at both side surfaces of the first end shield insertion groove 13 in the connector lateral direction. Furthermore, a press-in section 13*b* is formed in the center part of the first end shield insertion groove 13.

Figure 7:
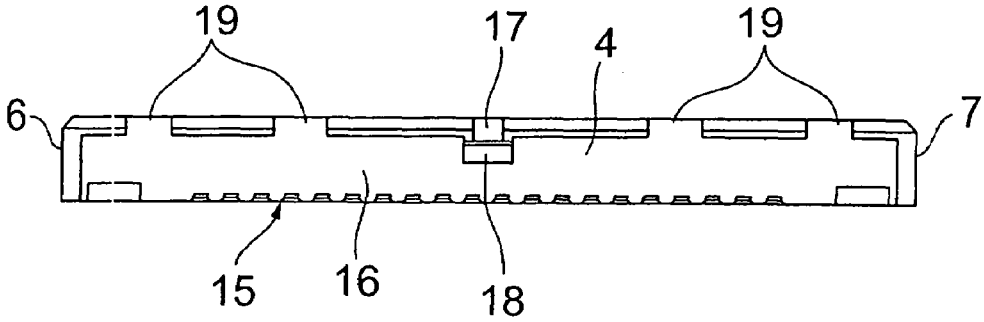
FIG. 7 is a side view of the connector housing of FIG. 6.

A side shield attaching section 15 is formed at both side surfaces of the connector housing 1. As shown in FIG. 7, those side shield attaching sections 15 have linear side shield grooves 16 along the longitudinal direction of the connector housing 1. A latch insertion groove 17 is formed at the center part of each side shield groove 16 being perpendicular to the side shield groove 16. A latching section 18 is formed at the both side surfaces of the connector housing 1 so as to be across the latch insertion groove 17. In addition, a plurality of insertion grooves 19 is formed so as to be perpendicular to the side shield grooves 16.

As shown in FIG. 9, a connecting section (one connecting section) 20, which connects the side shield grooves 16 to the insertion grooves 13*a*, is formed at the end shield attaching section 12 side of the side shield groove 16. Each of those connecting sections 20 is comprised of a groove 21 formed at the backside of the connector housing 1, and insertion hole 22 that connects the groove 21 to the insertion hole 13*a*.

Figure 4:
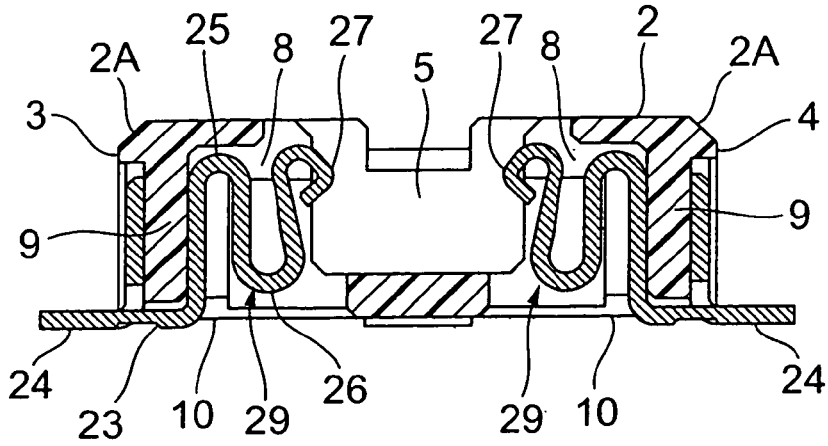
FIG. 4 is a cross-sectional view taken along line C—C of FIG. 1.

As shown in FIG. 4, each contact terminal 24 is comprised of a attaching section (press-in section) 23, a terminal lead section 24 provided at the end of the attaching section 23, an elasticity providing section 26 that is provided opposite to the terminal lead section and connected to the attaching section 23 via a curved connecting section 25, and a contact section 27 formed at the end of the elasticity providing section 26.

Each contact terminal 29 is attached to or pressed in the terminal attaching section 9 being inserted from each terminal insertion opening of the connector housing 1. More specifically, each contact terminal 29 is inserted in the terminal attaching section 9 between the dividing sections 8, by pressing therein, so that the terminal lead section 24 protrudes outward from the terminal insertion opening 10, and the contact section 27 faces the center part of the connector fitting section 2.

Figure 10:
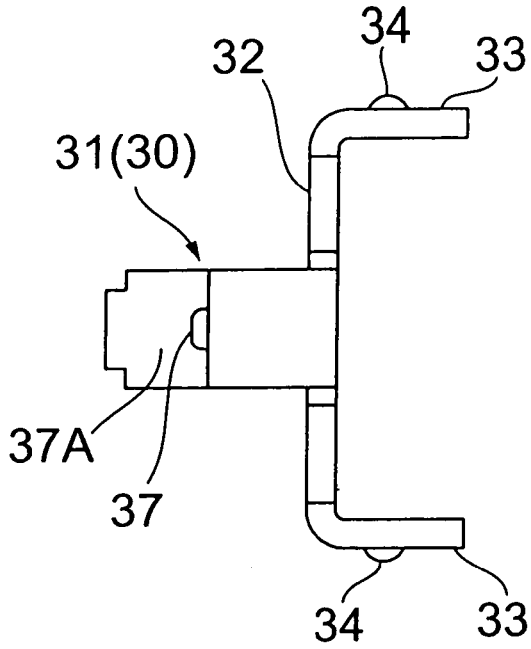
FIG. 10 is a top view of the end shield of the receptacle connector.
Figure 11:
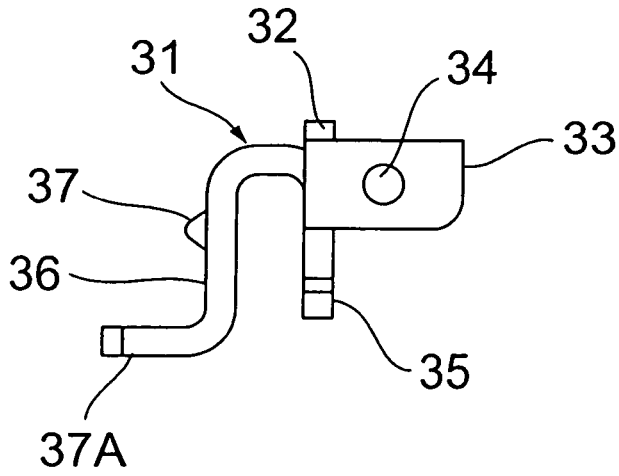
FIG. 11 is a side view of the end shield of FIG. 10.

The shielding member 30 is comprised of end shields 31 and side shields 40. As shown in FIGS. 10–11, each end shield 31 has a main shielding section 32, which has a squared U-shape on its top view. A contact point section (contact section provided on one side) is provided on the outer surface of the curved section 33, which are provided at the both ends of the main shielding section 32. In addition, a shield contact bar 36 is provided at the center part of the main shielding section 32 being curved and parallel to a press-in leg 35. A protrusion 37 is provided on the outer surface of the shielding contact bar 36. Furthermore, a shielding terminal 37A is formed at the end of the shielding contact bar 36.

Figure 12:
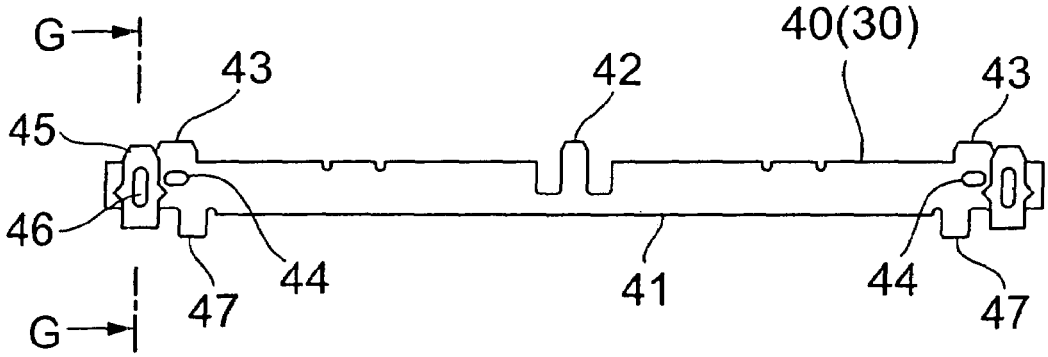
FIG. 12 is a side view of the side shield of the receptacle connector.
Figure 13:
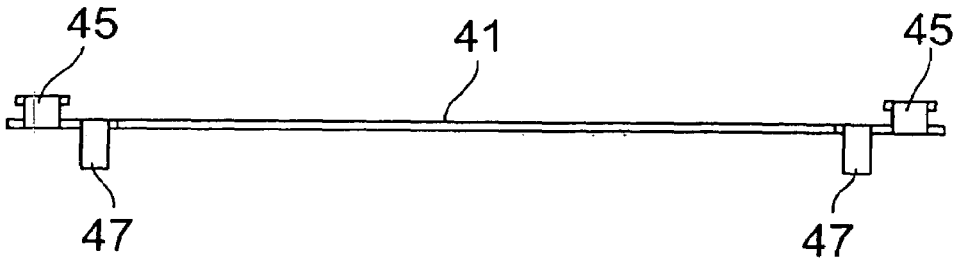
FIG. 13 is a top view of the side shield of FIG. 12.

Each side shield 40 has a strip-like main shielding section 41. As shown in FIG. 12, a latch 42 is formed at the center part of the main shielding section 41 being perpendicular to the main shielding section 41. A tongue 43 is formed at both sides across the latch 42 of the main shielding section 41 being perpendicular to the main shielding section 41. In addition, holes 44 are provided at the main shielding section 41 sharing one center axis of the tongue 43 on the side view of the side shield.

Figure 14:
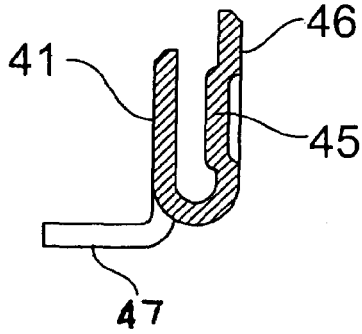
FIG. 14 is a cross-sectional view taken along line G—G of FIG. 12.

As shown in FIG. 14, a shield contact bar 45, which is curved to generally have a U-shape, is formed at both ends of the main shielding section 41. A contact point contact section 46 is formed at the outer surfaces of the shield contact bars 45. Moreover, a shield terminal 47 is provided at both ends of the main shielding section being perpendicular to the surface of the main shielding section 41.

Figure 2:
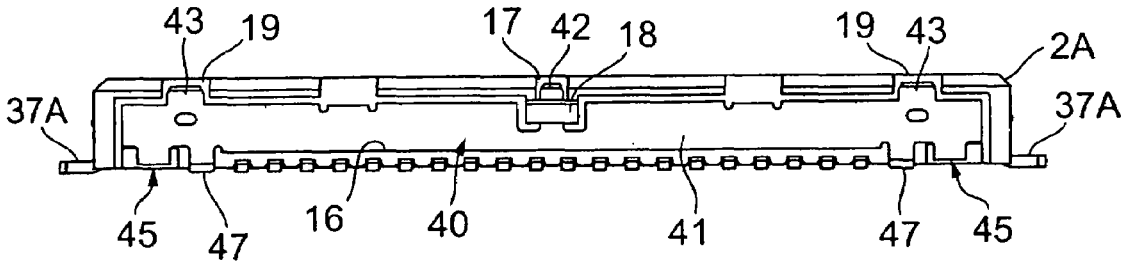
FIG. 2 is a side view of the receptacle connector of FIG. 1.
Figure 3:
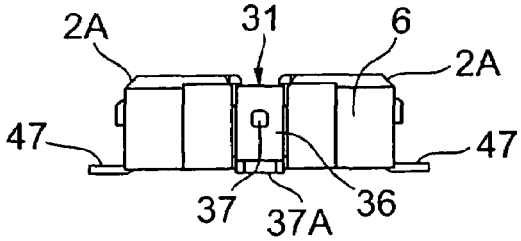
FIG. 3 is an end view of the receptacle connector of FIG. 1.

As shown in FIGS. 1–3, the end shield 31 is attached to the end shield attaching section 15 of the connector housing 1. More specifically, the main shielding section 32 is inserted in the first end shield insertion groove 13, and the press-in leg 33 is pressed in the press-in section 13*b*. At this time, the contact point section 34 of the curved sections 33 on both sides of the main shielding section 32 face the insertion groove 13*a* of the both side surface of the first end shield insertion groove 13. Each shield terminal 37A and the shielding contact bar 36 are inserted in the latching bar insertion groove 17, and latched in the latching section 18. The tongue 43 of the main shielding section 41 is inserted in the insertion groove 19.

Figure 5:
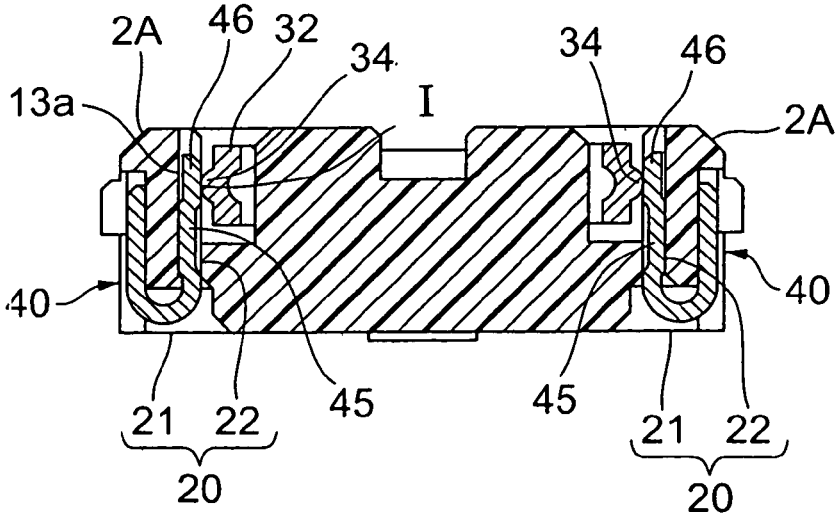
FIG. 5 is a cross-sectional view taken along line D—D of FIG. 1.
Figure 31:
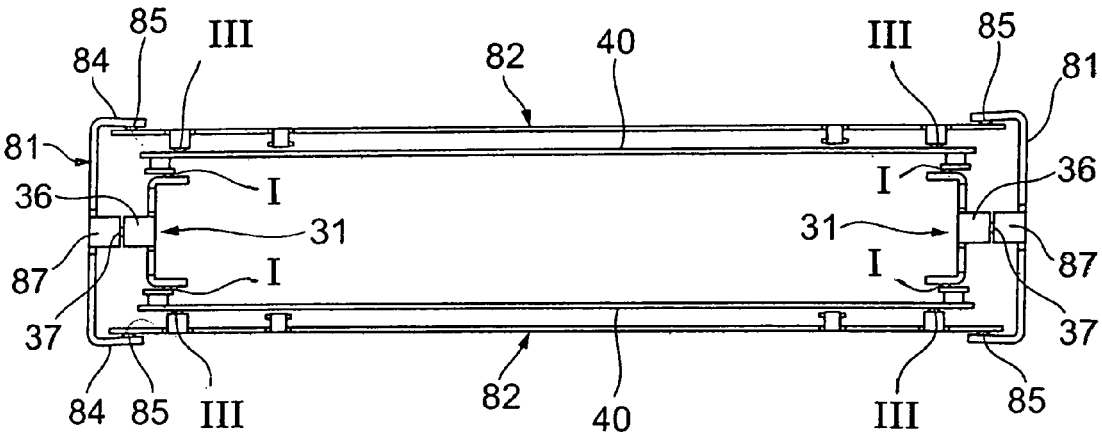
FIG. 31 is a top view when the shielding member of the receptacle connector is contacted with the shielding member of the plug connector.

As shown in FIG. 5, the shield contact bars 45 on both sides of the main shielding section 41 are inserted in the connecting sections 20 of the side shielding groove 16. More specifically, those shield contact bars 45 are inserted in the insertion grooves 13*a* of the end shield attaching sections 12 via the insertion hole 22 from the groove 21 of the connecting section 20. The contact point contact section 46 of each shield contact bar 45 contacts with the contact point 34 of the end shield 31. As shown in FIG. 31, there are four contact points I between the respective contact point sections 34 and the contact point contact sections 46. The end shields 31 and the side shields 40 are connected to each other at those contact points I, and the connector fitting section 2 is surrounded by a pair of end shields 31 and a pair of the side shields 40.

In the receptacle connector A having the above constitution, a positioning pin (not illustrated) provided on the bottom of the connector housing 1 is inserted in a positioning hole (not illustrated) of a printed circuit board. The terminal lead section 24 of each contact terminal 29 is soldered to a contact point pattern section by reflow soldering with solder cream, contacting the terminal lead section 24 to solder cream applied on the contact point pattern section (not illustrated) of the printed circuit board. In addition, as for a pair of the end shields 31 and a pair of the side shields 40, respective shielding terminals 37A and 47 are contacted to solder cream applied on the shielding pattern section of the printed circuit board and soldered thereto by reflow soldering.

Figure 15:
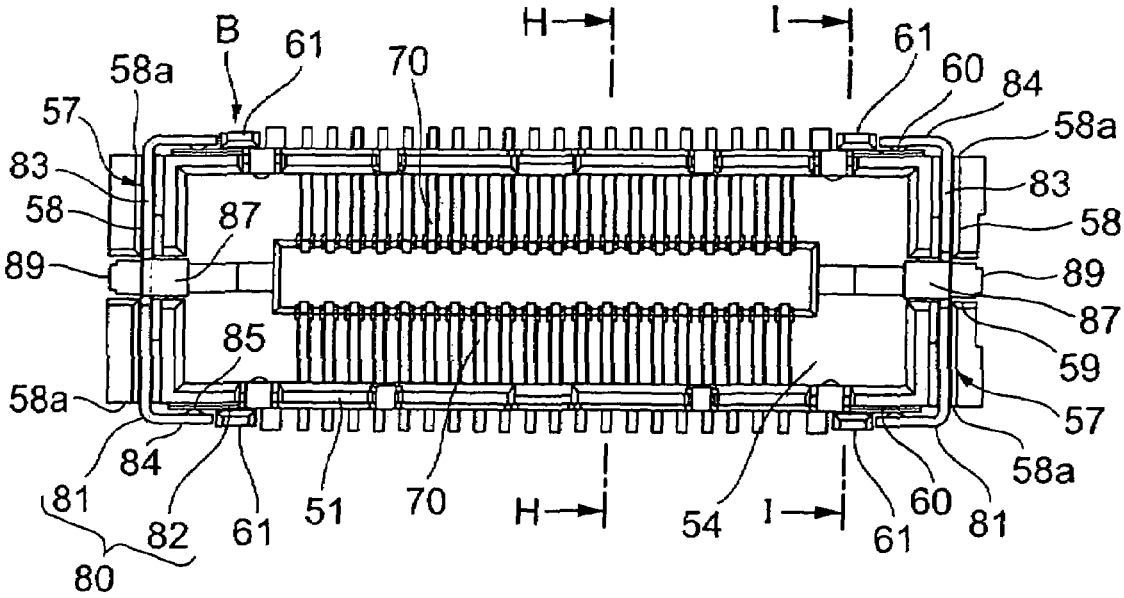
FIG. 15 is a top view of the plug connector of the electrical connector having a shield according to this invention.
Figure 16:
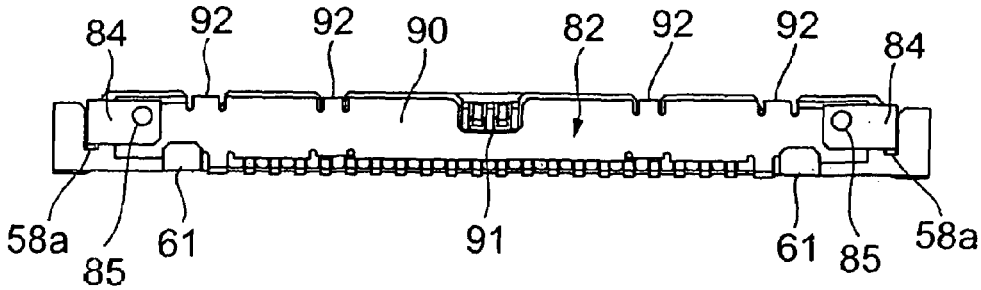
FIG. 16 is a side view of the plug connector of FIG. 15.
Figure 17:
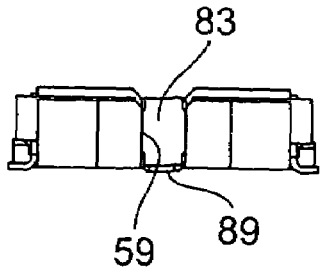
FIG. 17 is an end view of the plug connector of FIG. 15.

As shown in FIGS. 15–17, the plug connector B, the other connector, is comprised of a connector housing 51, a number of contact terminals (counter contact terminals) 70 provided at the connector fitting section (counter connector fitting section) 54 of the connector housing 51, and a shielding member (counter shielding member) 80.

Figure 18:
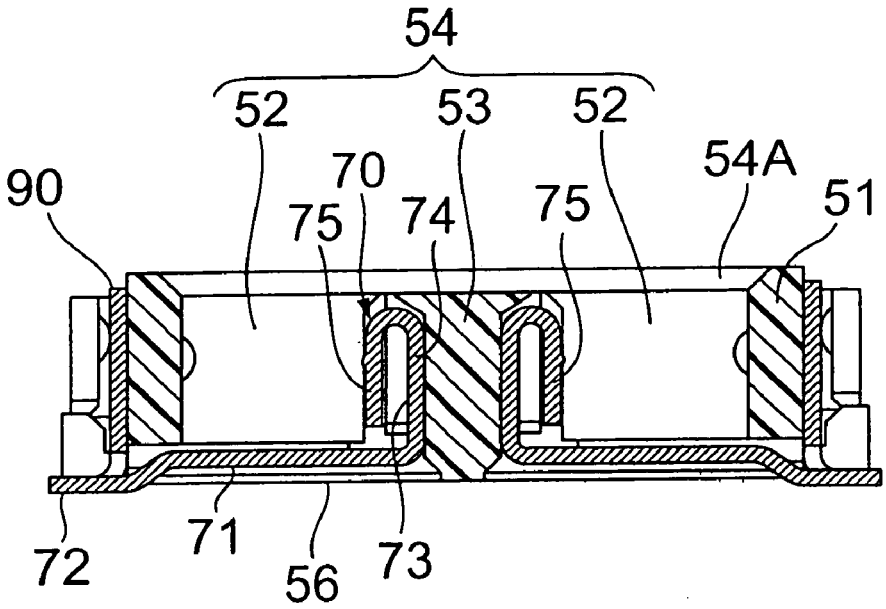
FIG. 18 is a cross-sectional view taken along line H—H of FIG. 15.
Figure 22:
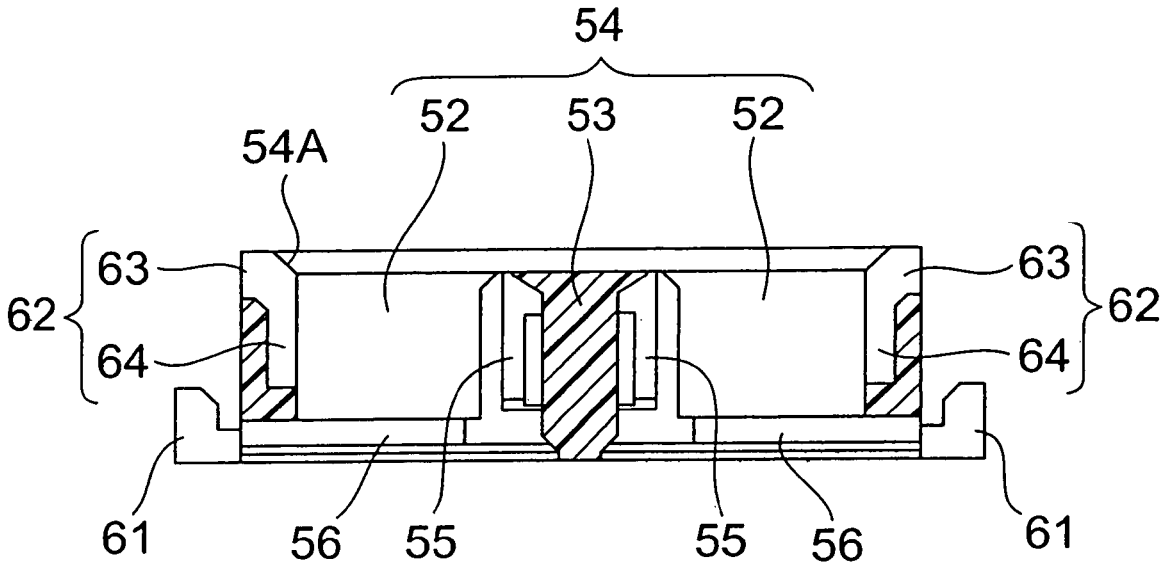
FIG. 22 is a cross-sectional view taken along line J—J of FIG. 20.

More specifically, as shown in FIG. 18, the connector housing 51 has a concave section 52 provided along the longitudinal direction of the connector, and a terminal attaching section 53 located in the center of the concave section 52. The connector fitting section 54 is formed by the concave section 52 and the terminal attaching section 53. The edges of the inner surfaces of the concave section are beveled so as to form the guiding sections 54A. As shown in FIG. 22, a number of terminal attaching grooves 55 are formed by a specified pitch along the longitudinal direction of the connector on both side surfaces of the terminal attaching sections 53.

Figure 29:
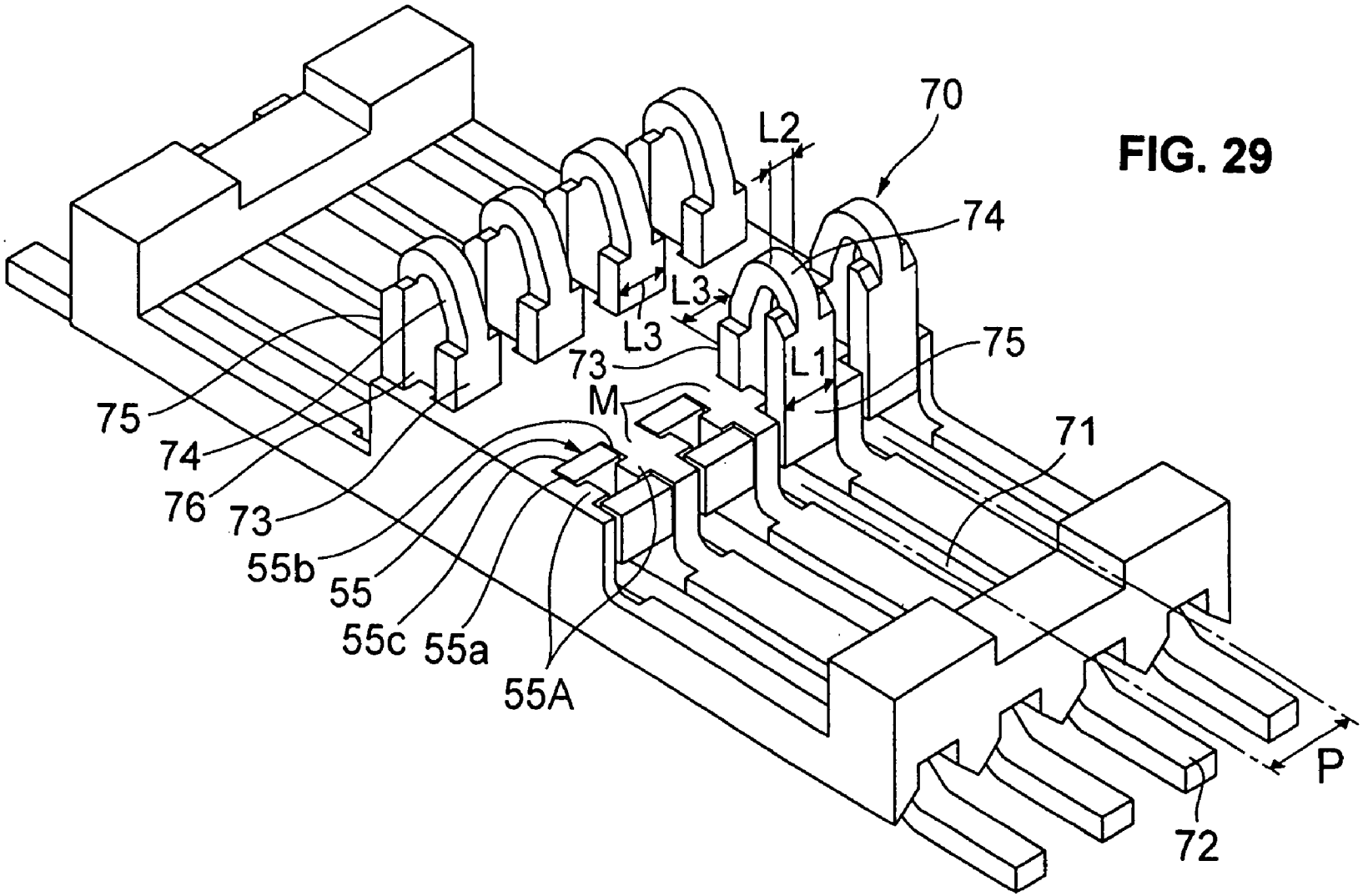
FIG. 29 is a partial perspective view of the structure of the plug connector to attach the contact terminals.
Figure 30:
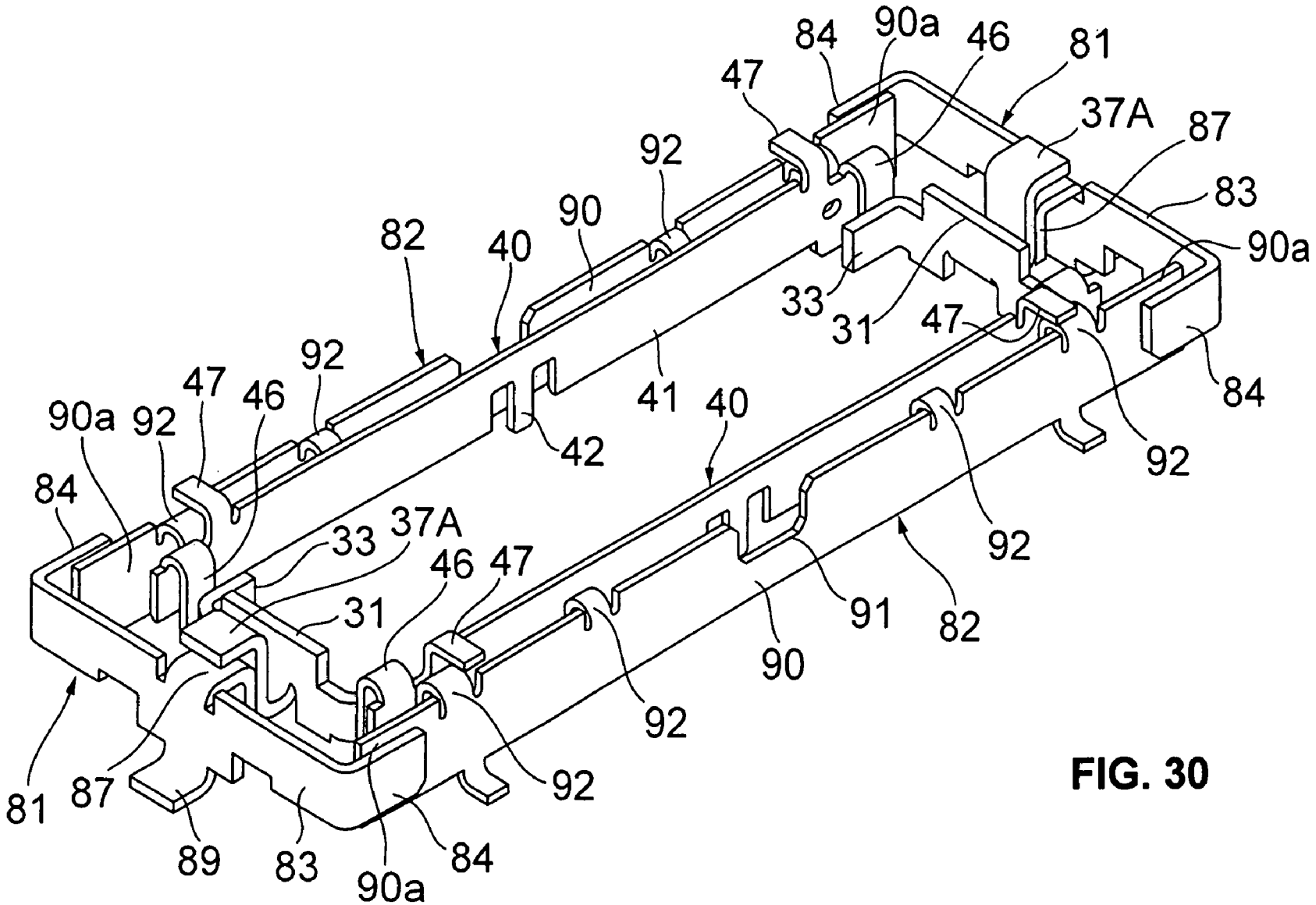
FIG. 30 is a perspective view when the shielding member of the receptacle connector is contacted with the shielding member of the plug connector.

As shown in FIG. 29, in each terminal attaching groove 55, mold stopper sections 55A protrude from the base portions of the both side wall sections 55*a* and 55*b*. Those mold stopper sections 55A face each other. The base portion of each terminal attaching groove 55 has a structure to hold the terminal, which is formed by the end surface 55*c* and a pair of mold stopper sections 55A. In addition, as shown in FIG. 22, terminal insertion openings 56 that connect to the respective terminal attaching grooves 55 are formed on the bottom part of the connector housing 51.

Figure 20:
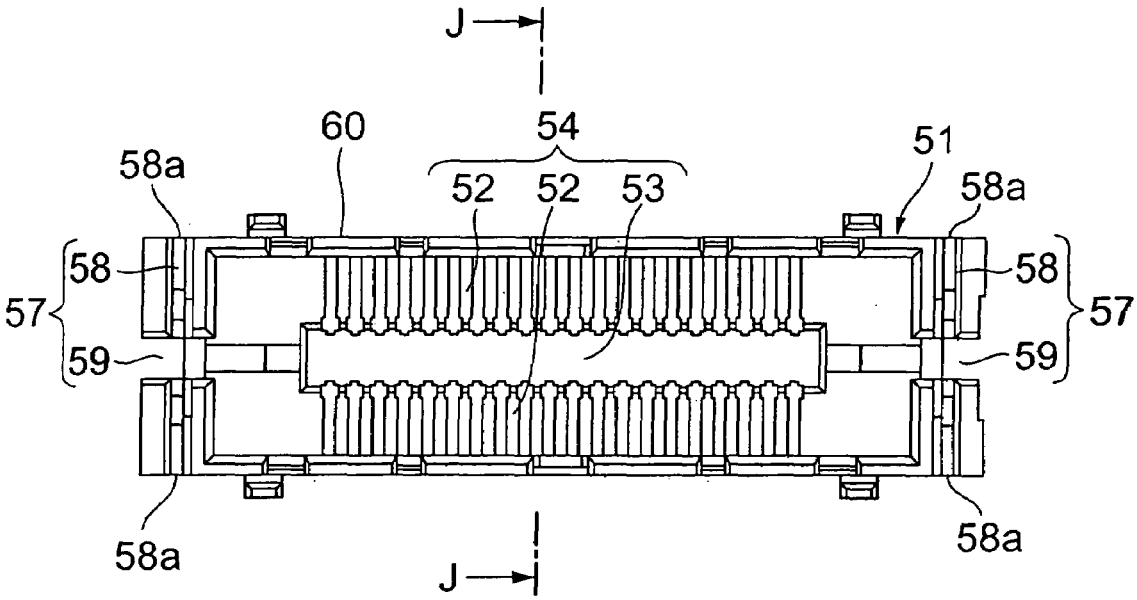
FIG. 20 is a top view of the connector housing of the plug connector of FIG. 15.

As shown in FIG. 20, a terminal shield attaching section (counter end shield attaching section) 57 is formed at both end sides in the longitudinal direction of the connector, being close to the ends of the connector fitting section 54. Each of those end shield attaching sections 57 is comprised of a first end shield insertion groove (counter end shield insertion groove) 58, which has a squared U-shape on its top view, and a second end shield insertion groove (counter end shield insertion groove) 59. The first end shield insertion groove 58 is connected to the side shield attaching section (counter side shield attaching section) 60 of the connector housing 51 at both ends in the lateral direction of the connector. The both ends 58*a* of each end shield insertion groove 58 forms the other connecting section.

Figure 21:
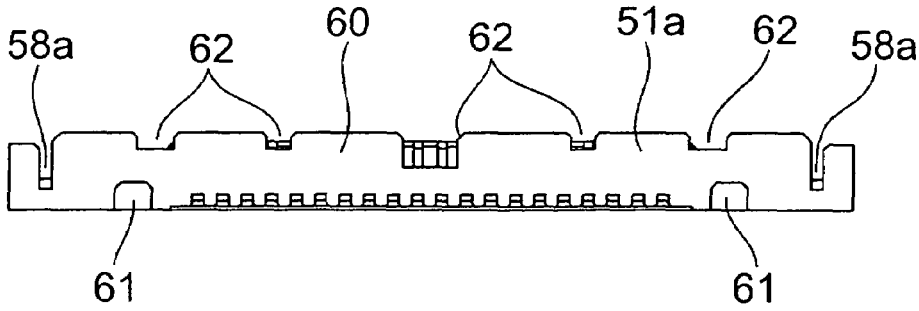
FIG. 21 is a side view of the connector housing of FIG. 20.

As shown in FIG. 21, each of those side shield attaching sections 60 is comprised of shield member receiving sections 61, which protrude from both ends of each side surface 51*a* of the connector housing 51 in the longitudinal direction of the connector, and shield contact bar attaching sections 62, which are formed at the edge of each side surface 51*a* of the connector housing 51. As shown in FIG. 22, each of those shield contact bar attaching sections 62 is comprised of a notch 63 formed at the edge of the side surface 51*a* and a groove 64 formed on the inner surface of the side surface 51*a*. The shield contact bar attaching section 62 having the above constitution is formed at five locations in the longitudinal direction of the connector on each side surface 51*a* of the connector housing 51. The width of the center shield contact bar attaching section 62 is set larger than the others.

As shown in FIGS. 18 and 29, each of the contact terminals 70 is comprised of a attaching section 71, a terminal lead section 72 provided at the end of the attaching section 71, a securing section that is curved for 90 degrees opposite to the terminal lead section 72, curved connecting section 74 that is curved for 180 degrees from the end of the securing section 73, and a contact section 75 formed at the end of the curved connecting section 74. In this case, the contact section 75 is generally parallel to the securing section 73, and space 76 is formed between the contact section 75 and the securing section 73.

As shown in FIG. 29, the width L1 of the contact section 75 is set larger than that L2 of the curved connecting section 74. In addition, the width L3 of the securing section 73 is smaller than the width L1 of the contact section 75, but larger than the width L2 of the curved connecting section. Each of the contact terminals 70 is inserted from each terminal insertion opening 56 of the connector housing 51, and attached to (pressed in) the terminal attaching groove 55. More specifically, the attaching section 71 of each contact terminal 70 is inserted in the terminal insertion opening 56 by pressing, and the terminal lead section 72 protrudes from the terminal insertion opening 56. While securing each securing section 73 onto the mold stopper section 55A, each contact section 75 is arranged at the center portion of the connector fitting section 54. In this case, each mold stopper section 55A is placed between the securing section 73 and the contact section 75, and the contact section 75 is secured so as not to move toward the securing section 73.

Figure 23:
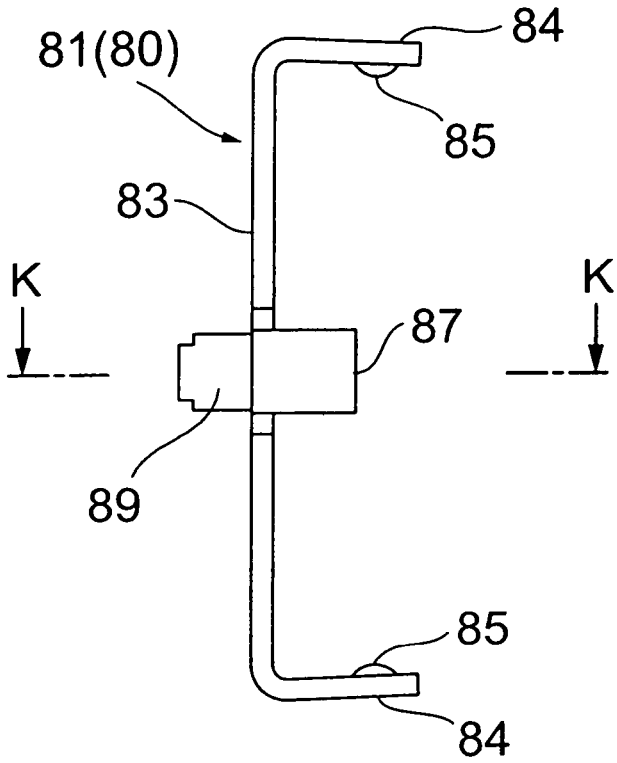
FIG. 23 is a top view of the end shield of the plug connector.
Figure 24:
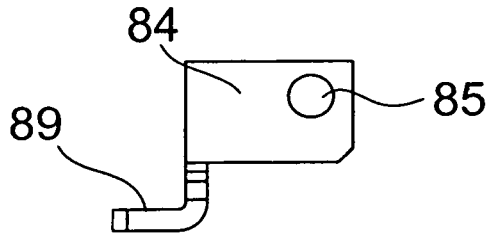
FIG. 24 is a side view of the end shield of FIG. 23.
Figure 25:
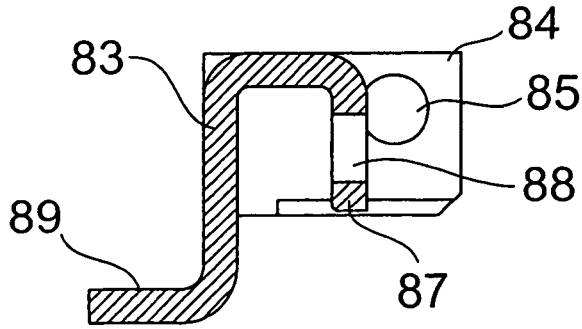
FIG. 25 is a cross-sectional view taken along line K—K of FIG. 23.

As shown in FIG. 29, in the above-described structure for attaching the contact terminals, since the width L3 of the securing section 73 is set smaller than the width L1 of the contact section 75, even if the pitch P between the contact terminals 70 is as narrow as 0.4 mm, each mold section M between the adjacent terminal attaching grooves 55 can be formed wide, and the generation of cracks of the mold sections M can be prevented. The shield member 80 is comprised of end shields (counter end shields) 81 and side shields (counter side shields) 82. As shown in FIGS. 23–25, each end shield 81 has a main shielding section 83, which has a squared U-shape on its top view, and has contact point sections (the other contact point sections) 85 on the inner surface of each curved section 84 on the both sides of the main shielding section 83. Furthermore, a shield contact bar 87, which is parallel to the main shielding section 83, is formed at the center portion of the main shielding section 83, being curved. Each shield contact bar 87 has a hole 88. A shield terminal 89 is provided at the center portion of the main shielding section 83, protruding opposite to the shield contacting bar 87.

Figure 26:
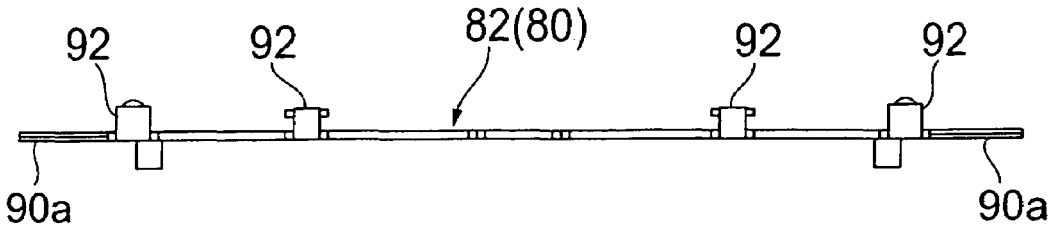
FIG. 26 is a top view of the side shield of the plug connector.
Figure 27:
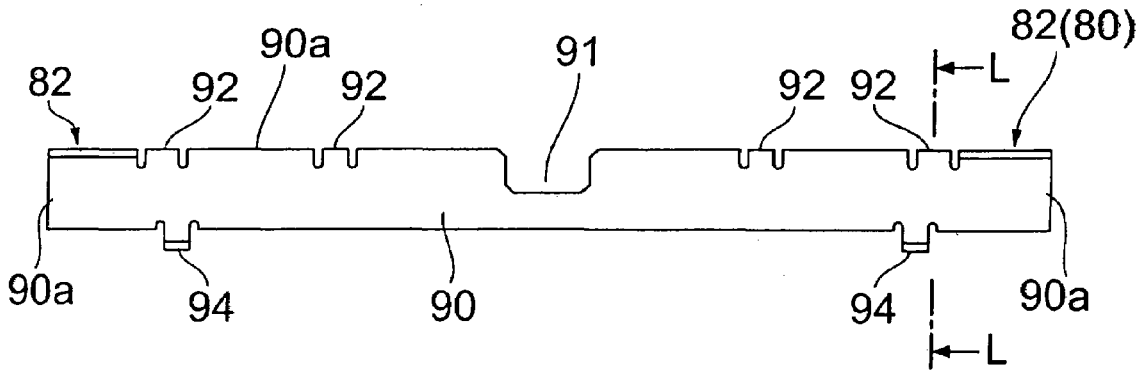
FIG. 27 is a side view of the side shield of FIG. 26.
Figure 28:
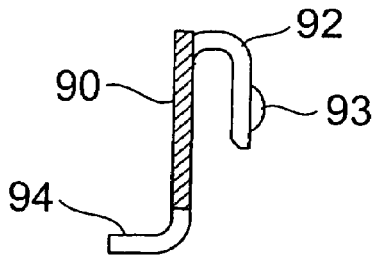
FIG. 28 is a cross-sectional view taken along line L—L of FIG. 27.

As shown in FIGS. 26–28, the side shield 82 has a strip-like main shielding section 90, and a notch 91 is formed at the center portion of the main shielding section 90. A pair of shield contact bars 92, which are curved so as to have a U-shape from the edge 90*a* of each main shielding section 90, are formed on both sides across the notch 91 of the main shielding section 90. A contact point section 93 protrudes from the outer surface of each shield contact bar 92. In addition, as shown in FIG. 28, a shield terminal 94 is formed at both sides of the main shielding section 90, being perpendicular to the surface of the main shielding section 90. Contact point contacting sections 90*a* (the other contact point contacting sections) are formed at both sides of the main shielding section 90.

Each end shield 81 is attached to the end shield attaching section 60 of the connector housing 51. More specifically, as shown in FIGS. 15–17, in the end shield 81, by inserting the main shielding section 83, which has a squared U-shape on its top view, into the first end shield attaching section 58 and having the end of the main shielding section protrude from the both ends 58*a* of the end shield insertion grooves 58, the contact point sections 85 of the curved section 84 on both sides of the main shielding section 83 face the side shield attaching section 60. Each shield terminal section 89 and the shield contacting bar 87 are inserted in the second end shield insertion groove 59.

Figure 19:
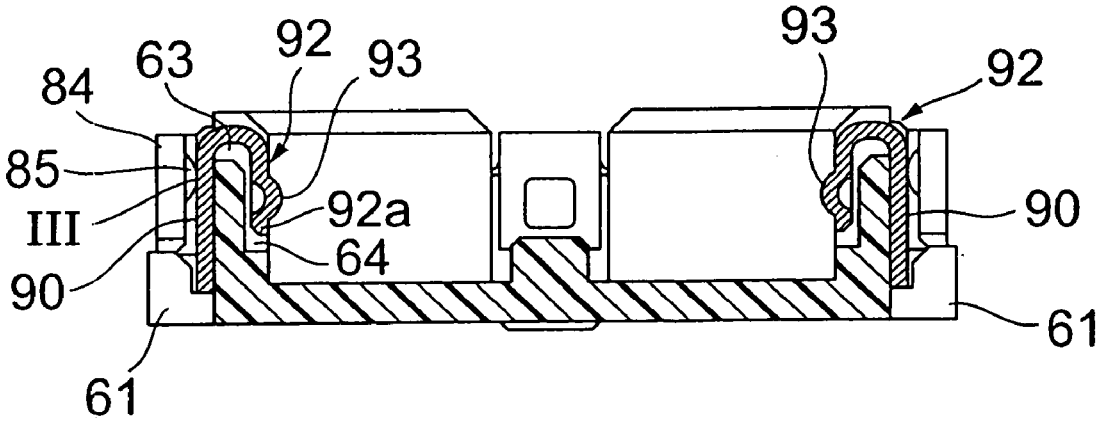
FIG. 19 is a cross-sectional view taken along line I—I of FIG. 15.

Each side shield 82 is attached to the side shield attaching section 60 of the connector housing 51. More specifically, as shown in FIG. 16, the main shielding section 90 of the side shield 82 is provided along each side shield attaching section 60, while the main shielding section 90 is supported by the shield member receiving section 61 and the shield contact bar 92 is attached to each shield contact bar attaching section 62. In this case, as shown in FIG. 19, the shield contacting bar 92 is provided over each notch 63, the curved edge 92*a* of the shield contacting bar 92 is inserted in each groove 64, and the contact point section 93 protrudes into the connector fitting section 54.

Each contact point section 85 of the end shields 81 contacts with the contact point contacting section 90*a* on both sides of the main shielding section 90 in the longitudinal direction of the connector. As shown in FIG. 31, there are four contact points III between the contact point sections 85 and the contact point contacting sections 90*a*. At those contact points III, the end shields 81 and the side shields 82 are connected to each other. The connector fitting section 54 is surrounded by the pair of the end shields 81 and the pair of the side shields 82.

In the plug connector B having the above-described constitution, the positioning pin (not illustrated) provided on the bottom of the connector housing 51 is inserted in the positioning hole of the printed circuit board (not illustrated), the terminal lead section 72 of each contact terminal 70 contacts with the solder cream applied on the contact pattern section (not illustrated) of the printed circuit board, and the terminal lead section 72 is soldered to the contact point pattern section of the printed circuit board by reflow soldering. On the other hand, as for the pair of the end shields 81 and the pair of the side shields 82, respective shield terminals 89 and 94 are contacted with solder cream applied on the shield pattern section (not illustrated) of the printed circuit board, and then soldered to the shielding pattern section by reflow soldering.

The connection between the receptacle connector A and the plug connector B, which respectively have the above constitutions, will be described below. By fitting the connector fitting section 2 of the receptacle connector A to the connector fitting section 54 of the plug connector B, the contact section 27 of each contact terminal 29 provided on the connector fitting section 2 of the receptacle connector A is contacted with the contact section 75 of a number of contact terminals 70 provided on the connector fitting section 54 of the plug connector B, and the plug connector B is connected to the receptacle connector A.

Figure 32:
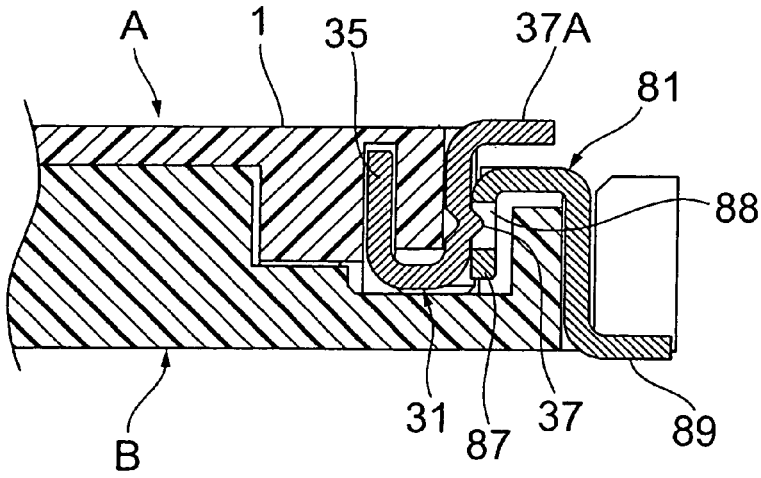
FIG. 32 is an explanatory view of the contact between the end shields when the receptacle connector is jointed to the plug connector.
Figure 33:
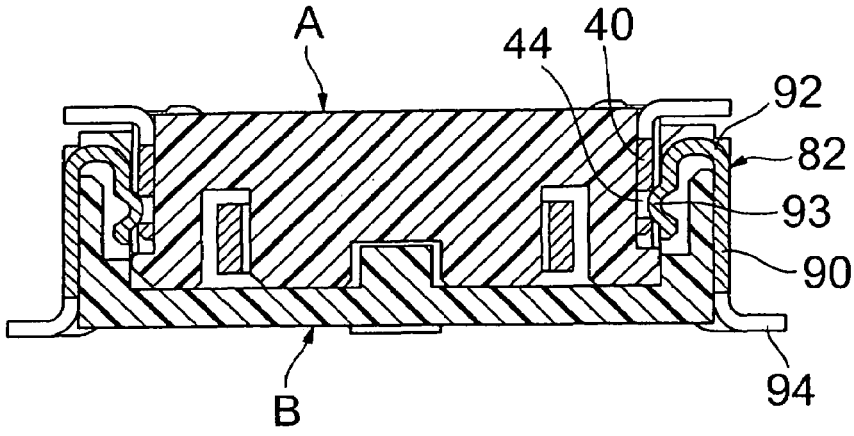
FIG. 33 is an explanatory view of the contact between the side shields when the receptacle connector is jointed to the plug connector.
Figure 34:
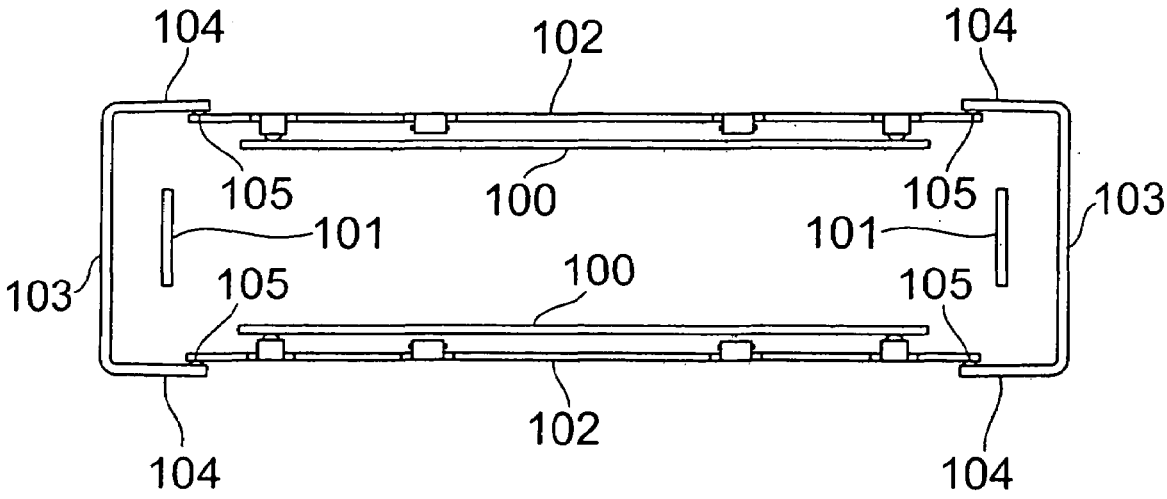
FIG. 34 PRIOR ART
FIG. 34 is an explanatory view of the contact between the end shields when the receptacle connector is jointed to the plug connector in the conventional electrical connector having a shield.

In this case, the end shields 31 of the receptacle connector A and the end shields 81 of the plug connector B are connected by inserting the protrusions 37 of the shield contact bars 36 into the holes 88 of the shield contact bars 87 and contacting the shield contact bars 36 and 87 as shown in FIG. 32. As shown in FIG. 33, the protrusion 93 of each side shield 82 is inserted in the hole 44 of the side shield 40, and the shield contact bar 92 contacts with the main shielding section 41.

When the protrusion 37 of each shield contact bar 36 is inserted in the hole 88 of each shield contact bar 87, and the protrusions 93 of the shield contact bar 92 of each side shield 82 is inserted in the holes 44 of each side shield 40, clicking feeling is generated. With this clicking feeling, it can be confirmed that the shielding member 30 of the receptacle connector A is contacted with the shielding member 80 of the plug connector B.

In addition, when the counter connector fitting section 2 of the receptacle connector A is fitted in the connector fitting section 54 of the plug connector B, the guiding sections 2A of the counter connector fitting section 2 contact with the guiding sections 54A of the connector fitting section 54, and are then guided so as to fit the connector fitting section 54 of the counter connector fitting section 2, so that the dislocation of the centers of the receptacle connector A and the plug connector B are corrected.

According to the above-described embodiment of this invention, the shielding member 30 for the receptacle connector A can be designed as a complete shielding structure that surrounds the connector fitting section 2. In addition, the shielding member 80 for the plug connector B can be designed as a complete shielding structure that surrounds the connector fitting section 54. When the receptacle connector A and the plug connector B are connected to each other by fitting the connector fitting sections 2 and 54 to each other, shielding is doubled, so that problems, such as unstable data transmission or a communication error in an electronic device due to noise leakage, can be solved.

Furthermore, according to the above-described embodiment of this invention, in the receptacle connector A, the end shield attaching section 12 is formed between the both end surfaces 6 and 7 of the connector housing in the lateral direction of the connector and the connector fitting section 2, and the end shield is attached to each end shielding attaching section 12. On the other hand, in the plug connector B, the end shield attaching section 57 is formed between the both ends of the connector housing 51 in the lateral direction of the connector and the connector fitting section 54, and the end shield is attached to each end shield attaching section 57. Therefore, space can be effectively used, and the whole size of the connector can be reduced.

According to the above-described embodiment of this invention, when the receptacle connector A is connected to the plug connector B by fitting the connector fitting sections 2 and 54 to each other, the shielding members 30 and 80 contact with each other. At this time, protrusions 37 and 93 are respectively inserted into the holes 88 and 80, and make clicking feeling. With this clicking feeling, it can be confirmed that the shielding members 30 and 80 are contacted to each other. Moreover, according to the above-described embodiment of this invention, when the connector fitting section 2 of the receptacle connector A is fitted into the connector fitting section 54 of the plug connector B, the guiding sections 2A of the connector fitting section 2 contacts with the guiding sections 54A of the connector fitting section 54, and the connector fitting section 2 is guided to fit into the connector fitting section 54, so that the displacement of centers of the receptacle connector A and the plug connector B is corrected.

According to the above-described embodiment of this invention, a number of terminal attaching grooves 55 are formed on the connector fitting section 54, and mold stopper sections 55A are protruded from base portion of both side walls of the terminal attaching grooves 55, so as to form structures to hold the terminals. As for the contact terminals 70, the width L1 of each contact section 75 is set larger than the width L2 of each curved connecting section 74. The width L3 of the securing section 73 is set smaller than the width L1 of the contact section 75, but larger than the width L2 of the curved connecting section 74. By attaching the contact terminals 70 to the terminal attaching sections 55, each securing section 73 is secured being pressed at the mold stopper section 55A. Since the width L3 of each securing section 73 is set smaller than the width L1 of the contact section 75, even if the pitch P between the contact terminals 70 is as small as 0.4 mm, the mold section M between adjacent terminal attaching grooves 55 can be made large, so that generation of cracks of the mold sections M can be prevented.

According to this invention, the shielding member has a complete shielding structure that surrounds the connector fitting section, and the counter shielding member has a complete shielding structure that surrounds the counter connector fitting section. Therefore, when the connectors are fitted and jointed to each other by fitting and jointing the connector fitting sections to the counter connector fitting sections, shielding structure is doubled. Therefore, problems such as unstable data transmission or communication errors in an electronic device due to noise leakage can be solved. In addition, the connector of this invention is useful as an electrical connector to connect between flat-type printed circuit boards.

The invention claimed is:

1. An electrical connector having a shield, comprising:

a first connector, which is comprised of:

a first connector housing having four first side surfaces;

a connector fitting section on said connector housing;

a plurality of contact terminals on said connector fitting section; and a shielding member on said first connector housing for covering the four first side surfaces; and a second connector, which is comprised of:

a second connector housing having four second side surfaces;

a counter connector fitting section on said second connector housing;

a plurality of counter contact terminals on said counter connector fitting section; and a counter shielding member on said second connector housing for covering the four second side surfaces, wherein said contact terminals and said counter contact terminals, and said shielding member and said counter shielding member are contacted and connected to each other when said connector fitting section is fitted to said counter connector fitting section, and said shielding member has a first shielding structure that surrounds an outer perimeter of said connector fitting section at the four first side surfaces, and said counter shielding member has a second shielding structure that surrounds an outer perimeter of said counter connector fitting section at the four second side surfaces and overlaps with the shielding member at the four second side surfaces.

2. The electrical connector having a shield according to claim 1, wherein said counter connector fitting section has a plurality of terminal attaching grooves and a mold stopper section, which is protruded from a base portion of both side walls of said terminal attaching grooves so as to form a structure for holding each terminal, and said counter contact terminal is comprised of:

an attaching section;

a terminal lead section provided at an end of said attaching section;

a securing section, which is curved opposite to said terminal lead section;

a curved connecting section which is curved to form generally U-shape from an end of said securing section; and a contact section formed at an end of said curved connecting section, wherein a width L1 of said contact section is set larger than a width L2 of said curved connecting section, a width L3 of said securing section is set smaller than said width L1 of said contact section, but larger than said width L2 of said curved connecting section, and said securing section is secured being pressed at said mold stopper section by attaching said counter contact terminal to said terminal attaching section.

3. The electrical connector having a shield according to claim 1, wherein each of said connector fitting section and said counter connector fitting section has a guiding section, so that said guiding sections contact to each other and guide said connector fitting section to said counter connector fitting section at the time of fitting said connector fitting section to said counter connector fitting section.

4. The electrical connector having a shield according to claim 3, wherein said counter connector fitting section has a plurality of terminal attaching grooves and a mold stopper section, which is protruded from a base portion of both side walls of said terminal attaching grooves so as to form a structure for holding each terminal, and said counter contact terminal is comprised of:

an attaching section;

a terminal lead section provided at an end of said attaching section;

a securing section, which is curved opposite to said terminal lead section;

a curved connecting section which is curved to form generally U-shape from an end of said securing section; and a contact section formed at an end of said curved connecting section, wherein a width L1 of said contact section is set larger than a width L2 of said curved connecting section, a width L3 of said securing section is set smaller than said width L1 of said contact section, but larger than said width L2 of said curved connecting section, and said securing section is secured being pressed at said mold stopper section by attaching said counter contact terminal to said terminal attaching section.

5. The electrical connector having a shield according to claim 1, wherein said shielding member is comprised of:

side shields that cover said connector fitting section along a connector longitudinal direction from both sides of said first connector housing; and end shields that cover said connector fitting section along a connector lateral direction from both ends and are connected to said side shields, and said counter shielding member is comprised of:

counter side shields that cover said counter connector fitting section along said connector longitudinal direction from both sides of said second connector housing; and counter end shields that cover said connector fitting section along said connector lateral direction from both ends and are connected to said side shields.

6. The electrical connector having a shield according to claim 5, wherein each of said connector fitting section and said counter connector fitting section has a guiding section, so that said guiding sections contact to each other and guide said connector fitting section to said counter connector fitting section at the time of fitting said connector fitting section to said counter connector fitting section.

7. The electrical connector having a shield according to claim 5, wherein said counter connector fitting section has a plurality of terminal attaching grooves and a mold stopper section, which is protruded from a base portion of both side walls of said terminal attaching grooves so as to form a structure for holding each terminal, and said counter contact terminal is comprised of:

an attaching section;

a terminal lead section provided at an end of said attaching section;

a securing section, which is curved opposite to said terminal lead section;

a curved connecting section which is curved to form generally U-shape from an end of said securing section; and a contact section formed at an end of said curved connecting section, wherein a width L1 of said contact section is set larger than a width L2 of said curved connecting section, a width L3 of said securing section is set smaller than said width L1 of said contact section, but larger than said width L2 of said curved connecting section, and said securing section is secured being pressed at said mold stopper section by attaching said counter contact terminal to said terminal attaching section.

8. The electrical connector having a shield according to claim 5, wherein said first connector further comprising:

a side shield attaching section for attaching said side shields, which is provided on two of the four first side surfaces of said first connector housing along said connector longitudinal direction; and an end shield attaching section for attaching the end shields, which is provided along said connector lateral direction between both end surfaces of said connector housing and said connector fitting section, and said second connector further comprising:

a counter side shield attaching section for attaching said counter side shields, which is provided on two of the four second side surfaces of said second connector housing along said connector longitudinal direction; and a counter end shield attaching section for attaching the counter end shields, which is provided between both end surfaces of said second connector housing along said connector lateral direction and said connector fitting section.

9. The electrical connector having a shield according to claim 8, wherein each of said connector fitting section and said counter connector fitting section has a guiding section, so that said guiding sections contact to each other and guide said connector fitting section to said counter connector fitting section at the time of fitting said connector fitting section to said counter connector fitting section.

10. The electrical connector having a shield according to claim 8, wherein said counter connector fitting section has a plurality of terminal attaching grooves and a mold stopper section, which is protruded from a base portion of both side walls of said terminal attaching grooves so as to form a structure for holding each terminal, and said counter contact terminal is comprised of:

an attaching section;

a terminal lead section provided at an end of said attaching section;

a securing section, which is curved opposite to said terminal lead section;

a curved connecting section which is curved to form generally U-shape from an end of said securing section; and a contact section formed at an end of said curved connecting section, wherein a width L1 of said contact section is set larger than a width L2 of said curved connecting section, a width L3 of said securing section is set smaller than said width L1 of said contact section, but larger than said width L2 of said curved connecting section, and said securing section is secured being pressed at said mold stopper section by attaching said counter contact terminal to said terminal attaching section.

11. The electrical connector having a shield according to claim 8, wherein said shielding member contacts with said counter shielding member by contacts between said side, shields and said counter side shields and contacts between said end shields and said counter end shields, said side shields or said counter side shields and said end shields or said counter end shields have protrusions, and said counter side shields or said side shields and said counter end shields or end shields have holes, so that clicking feeling is generated by inserting said protrusions to said holes when the shielding member contacts with the counter shielding member.

12. The electrical connector having a shield according to claim 11, wherein each of said connector fitting section and said counter connector fitting section has a guiding section, so that said guiding sections contact to each other and guide said connector fitting section to said counter connector fitting section at the time of fitting said connector fitting section to said counter connector fitting section.

13. The electrical connector having a shield according to claim 11, wherein said counter connector fitting section has a plurality of terminal attaching grooves and a mold stopper section, which is protruded from a base portion of both side walls of said terminal attaching grooves so as to form a structure for holding each terminal, and said counter contact terminal is comprised of:

an attaching section;

a terminal lead section provided at an end of said attaching section;

a securing section, which is curved opposite to said terminal lead section;

a curved connecting section which is curved to form generally U-shape from an end of said securing section; and a contact section formed at an end of said curved connecting section, wherein a width L1 of said contact section is set larger than a width L2 of said curved connecting section, a width L3 of said securing section is set smaller than said width L1 of said contact section, but larger than said width L2 of said curved connecting section, and said securing section is secured being pressed at said mold stopper section by attaching said counter contact terminal to said terminal attaching section.

14. The electrical connector having a shield according to claim 11, wherein said first connector is further comprised of:

an end shield insertion groove on said end shield attaching section along said connector lateral direction;

a side shield insertion groove on said side shield attaching section along said connector longitudinal direction;

a first connecting section that connects said side shield groove to said end shield insertion groove, a first contact point section on each of said end shields; and a first contact point contact section on each of said side shields, and said second connector is further comprised of:

a counter end shield insertion groove on said counter end shield attaching section along said connector lateral direction;

a second connecting section that connects said counter end shield insertion groove to said counter side attaching section, a second contact point section on each of said counter end shields; and a second contact point contact section on each of said counter side shields, wherein said first contact point section is protruded from said first connecting section toward said side shield groove by inserting said end shield to said end shield insertion groove, and said first contact point contact section is contacted with said first contact point contact section by attaching said side shield to said side shield groove, and said second contact point section is protruded from said second connecting section toward said counter side shield attaching section by inserting said counter end shield to said counter end shield insertion groove, and said second contact point section is contacted with said second contact point contact section by attaching said counter side shield to said counter side shield attaching section.

15. The electrical connector having a shield according to claim 14, wherein each of said connector fitting section and said counter connector fitting section has a guiding section, so that said guiding sections contact to each other and guide said connector fitting section to said counter connector fitting section at the time of fitting said connector fitting section to said counter connector fitting section.

16. The electrical connector having a shield according to claim 14, wherein said counter connector fitting section has a plurality of terminal attaching grooves and a mold stopper section, which is protruded from a base portion of both side walls of said terminal attaching grooves so as to form a structure for holding each terminal, and said counter contact terminal is comprised of:

an attaching section;

a terminal lead section provided at an end of said attaching section;

a securing section, which is curved opposite to said terminal lead section;

a curved connecting section which is curved to form generally U-shape from an end of said securing section; and a contact section formed at an end of said curved connecting section, wherein a width L1 of said contact section is set larger than a width L2 of said curved connecting section, a width L3 of said securing section is set smaller than said width L1 of said contact section, but larger than said width L2 of said curved connecting section, and said securing section is secured being pressed at said mold stopper section by attaching said counter contact terminal to said terminal attaching section.

* * * * *